US005472380A

United States Patent [19]

Sarazen, Jr. et al.

[11] Patent Number: 5,472,380

[45] Date of Patent: Dec. 5, 1995

[54] MODULAR FORCED-AIR FLOOR REGISTER WITH FILTER

[76] Inventors: Paul M. Sarazen, Jr., 214 Fairview Dr.; Dennis A. Beam, Jr., 410 Westfield Dr., both of Shelby, N.C. 28150

[21] Appl. No.: 249,390

[22] Filed: May 26, 1994

[51] Int. Cl.[6] ..... F24F 13/075

[52] U.S. Cl. ..... 454/290; 55/385.2; 55/491; 55/493; 55/511; 454/324; 454/332

[58] Field of Search ..... 454/284, 290, 454/324, 331, 332, 334; 55/385.2, 436, 491, 493, 497, 506, 507, 511

[56] References Cited

U.S. PATENT DOCUMENTS

| | | | |
|---|---|---|---|
| 32,897 | 7/1861 | Sexton . | |
| D. 315,790 | 3/1991 | Koessler . | |
| 448,141 | 3/1891 | Northen . | |
| 637,519 | 11/1899 | Mertins | 55/491 X |
| 1,488,694 | 4/1924 | Marks . | |
| 1,493,875 | 5/1924 | Frederick . | |
| 1,559,376 | 10/1925 | Riker . | |
| 1,694,089 | 12/1928 | Wright . | |
| 1,739,372 | 12/1929 | Pirchio . | |
| 1,911,851 | 5/1933 | Scholtz . | |
| 2,042,310 | 5/1936 | Hilk | 454/331 |
| 2,050,605 | 8/1936 | Gordon et al. | 55/511 X |
| 2,123,751 | 7/1938 | Sigal | 454/324 X |
| 2,201,830 | 5/1940 | Hoffer et al. . | |
| 2,308,262 | 1/1943 | Beil . | |
| 2,575,499 | 11/1951 | Manow . | |
| 2,719,598 | 10/1955 | Lindner | 55/491 |
| 3,046,719 | 7/1962 | Tropiano . | |
| 3,236,171 | 2/1966 | Vaskov et al. | 454/332 X |
| 3,366,031 | 1/1968 | Hedrick et al. | 454/332 |
| 3,391,629 | 7/1968 | Snell . | |
| 3,403,615 | 10/1968 | Dayus . | |
| 3,426,668 | 2/1969 | Hofmeister et al. . | |
| 3,528,359 | 9/1970 | Sand | 454/324 |
| 3,740,934 | 6/1973 | Shuler . | |
| 3,777,650 | 12/1973 | Wenig . | |
| 3,815,638 | 6/1974 | Martin | 454/331 X |
| 4,407,187 | 10/1983 | Horney | 454/324 |
| 4,549,887 | 10/1985 | Joannou . | |
| 5,100,445 | 3/1992 | Johnson et al. | 55/493 X |
| 5,141,707 | 8/1992 | Brite . | |

OTHER PUBLICATIONS

Automotive News, "Climatic Air" Imperial Automobile Article (Apr. 8, 1963).

Lime Register Company "Lime" Brochure (Oct. 1968).

*Primary Examiner*—Harold Joyce

*Attorney, Agent, or Firm*—Dority & Manning

[57] ABSTRACT

A modular forced-air register includes two main sub-assemblies. A housing with an opening can be disposed into a hole in the floor of a room. A second sub-assembly includes a louver plate with a grid work of tri-directional vanes. Air flow is controlled by a slide grille disposed beneath the grid work and carrying an integral filter substrate secured to the slide grille. The two sub-assemblies are detachably connected to each other by an arrangement of bosses and recesses as well as a projection mounted on a flexible tang configured and disposed to engage a pocket configured in a thin wall region of the opposing sub-assembly.

13 Claims, 7 Drawing Sheets

MODULAR FORCED-AIR FLOOR REGISTER WITH FILTER

BACKGROUND OF THE INVENTION

The present invention relates to registers for heating and air conditioning systems and more particularly to built-in, forced-air floor registers.

U.S. Pat. No. 448,141 to Northen provides an example of a floor register for introducing hot air into a room. The Northen register has an outer box E with its walls extending slightly above the floor A and flared outwardly so as to be supported by the floor A. The Northen register includes a box D, which is connected to the hot air flue C and enclosed by outer box E, which fits upon the flue-pipe C. Frame g encloses the register-shutters G. Box D is nailed to the floor A by supporting-strips d' that extend across and overlap the top walls of outer box E. As shown in FIG. 4 of Northen, the register has a face B that includes integrally cast fret-work and has flanges b, b', and $b^2$ extending downwardly and entirely surrounding the face B, either continuously or in sections. Flange $b^2$ rests upon the floor A. Flange b fits within outer box E. Flange b' cooperates with the frame g to form a tapering recess adapted to receive the upper edge of box D and make a close joint. The face B of the register may be lifted out of the box D without disturbing the box D.

U.S. Pat. No. 1,694,089 to Wright discloses a hot-air register 2 disposed through the floor 3 with a hot air pipe 4 connected to the register box 5. Register 2 has a supporting frame 6 that carries louvers 7. A fabric covering 13 may be disposed within box 5 over a skeleton frame having a rim portion 9 and upright portions 10, which carry supporting top bars 11. A retaining ring 12 holds the fabric portion 13 against rim portion 9 in a trough 14, which can be filled with water that will be taken up by capillary attraction to moisten the fabric cover 13.

In U.S. Pat. No. 1,739,372 to Pirchio, a generally conventional hot air register B having a perforated metal lid C and being flanged at its lower open side for receiving the flanged end of the usual hot air conveying pipe D, may include a conical shaped metallic container 5 with air inlet openings 6 and a bottom wall 7 of foraminous material. A non-corrosive fire resisting filter medium 8 such as metal, wool or the like, is disposed within container 5. A circular lid 9 of wire screening having a wire rim 10 maintains the wool in a compact mass within container 5.

U.S. Pat. No. 3,046,719 to Tropiano discloses a register that is mounted to the wall via disks 12 having pins 11 that are received within sockets 10 formed in the frame 8 of the register. The register has a depth that is disposed in front of the surface of the room wall and contains a rear rabbet 14 which receives a filter 17 disposed behind the stationary grating 18. The register has a slidable removable damper 26 with a handle 30 for controlling the proportion of the grating 18 open to the passage of air.

Registers with tri-directional air flow are disclosed in U.S. Pat. Nos. 3,391,629 (Snell) and 3,403,615 (Dayus).

In a molded plastic heat register such as shown in U.S. Pat. No. Des. 315,790 to Koessler, a slider type of louver mechanism is disposed beneath the top grille-work to regulate the proportion of the open area in the grille to control the amount of air flowing through the register into the room.

In U.S. Pat. No. 5,141,707 to Brite, a floor register 50 can include an upper plate 52 with air outlet flow vanes 54 and an air control flap 56 pivotably mounted beneath plate 52. An odorant container 60 has a hinged cover 70.

OBJECTS AND SUMMARY OF THE INVENTION

It is a principal object of the present invention to provide an improved forced-air, floor register that filters the air yet provides easy access for cleaning the filter without touching the filter.

It is another object of the present invention to provide a forced-air, filter register that lends itself to economical manufacture and installation along with the benefits of providing easy access to the filter for purposes of cleaning the filter without requiring the operator to physically touch the filter.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the modular filter register of the present invention comprises two detachable main sub-assemblies. One of the main sub-assemblies includes a housing having a flat top flange defining a first opening. The housing also has an outer skirt aligned with the first opening and depending in a direction perpendicular to the plane of the top flange of the housing. The housing is configured to be inserted into a hole in the floor of a room of an edifice, and the top flange rests atop the floor and can be secured to the floor if desired.

The modular filter register of the present invention includes a second sub-assembly comprising three separate components. One component of the second sub-assembly is a louver plate which includes a border flange defining a second opening and a top grille forming a partially open lattice structure across the second opening. The lattice structure includes a plurality of width-wise vanes configured and disposed to extend across the width of the second opening. Each width-wise vane has three integral but distinct wall members, including a pair of side walls disposed parallel to each other and a top wall disposed in a horizontal plane and connecting one set of the ends of the pair of side walls. A pair of length-wise ribs extends along the length of the top grille and intersects perpendicularly with each vane. The lattice structure of the top grille is tri-directional because the width-wise vanes are grouped into three groups of vanes. Each group of the three groups of width-wise vanes is distinct from the other two groups of width-wise vanes because of the way that the vanes in the group are configured to deflect the air in one of three distinct directions.

The louver plate also includes an inner skirt depending in a normal direction from the border flange and aligned with the second opening. The inner skirt has a perimeter sized to fit into the first opening in the top flange of the housing.

The second component of the second main sub-assembly of the modular filter register of the present invention is a slide grille, which is disposed beneath the top grille and defines a third opening aligned with the second opening in the louver plate. The slide grille is configured with width-wise vanes and length-wise ribs that are complementary to the vanes and ribs of the top grille. Each of the width-wise vanes in the slide grille has a transverse cross-sectional shape in the form of a "T" with the top of the "T" interfacing with the bottom edges of the width-wise vanes in the top grille when the slide grille is disposed so that the second opening in the louver plate is open to the flow of air. The width-wise vanes of the slide grille open and close the spaces between the vanes in the top grille when the slide grille slides back and forth beneath the top grille. A plurality of J-shaped members extends from and below the bottom edge of the slide grille.

A handle for moving the slide grille to open and close the air spaces between adjacent width-wise vanes in the top grille, is disposed off center and toward one end of the rectangular opening in the louver plate and has a generally curved cross-section.

The third component of the second main sub-assembly is an integral filter substrate, which is configured to be impaled on the ends of the J-shaped members and cover the gaps disposed between the vanes and ribs in the slide grille.

The two main sub-assemblies are provided with a means for detachably attaching one to the other to permit the filter to be cleaned and/or replaced. Such means can include an access slot disposed in the border flange of the louver plate in alignment with a projection that is detachably engageable into a pocket defined in a thin wall region of a first end wall of the outer skirt of the housing. Such means also can include at least one boss that is detachably lockable into a recess defined in a second end wall of the outer skirt of the housing.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
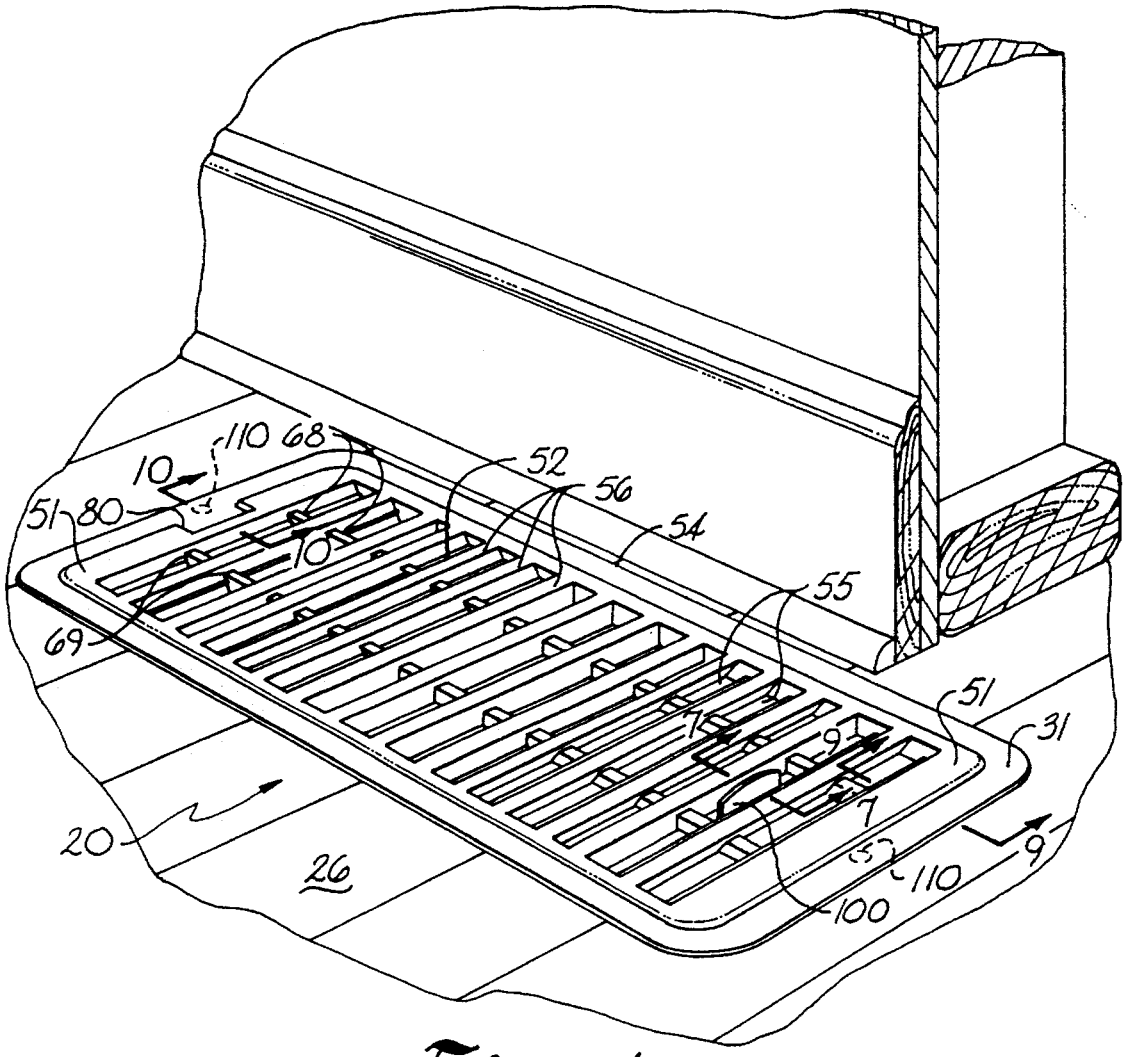
FIG. 1 is an elevated perspective view of a preferred embodiment of the present invention installed in the floor of a room.
Figure 9:
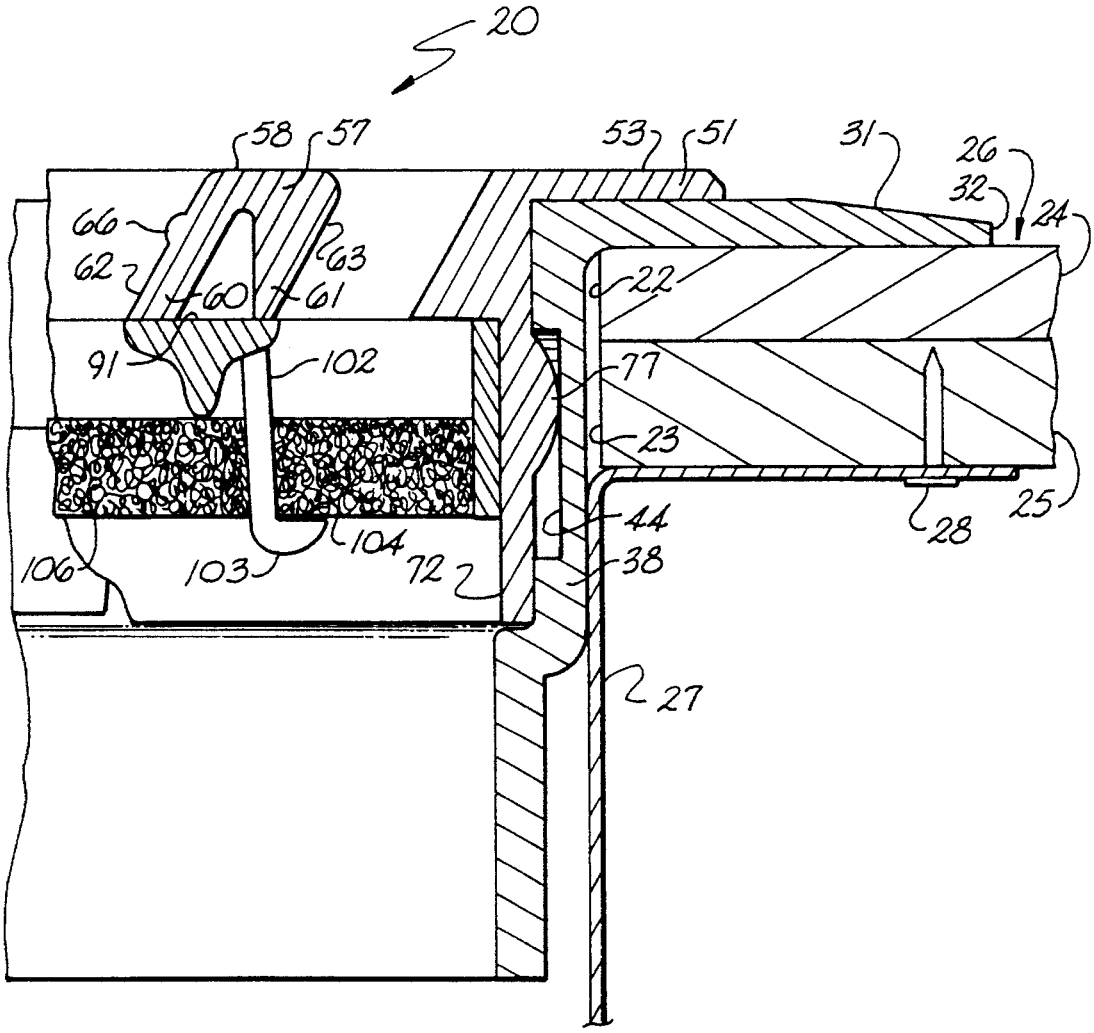
FIG. 9 is a partial cross-sectional view taken in the direction in which arrows 9—9 are pointing in FIG. 1.
Figure 10:
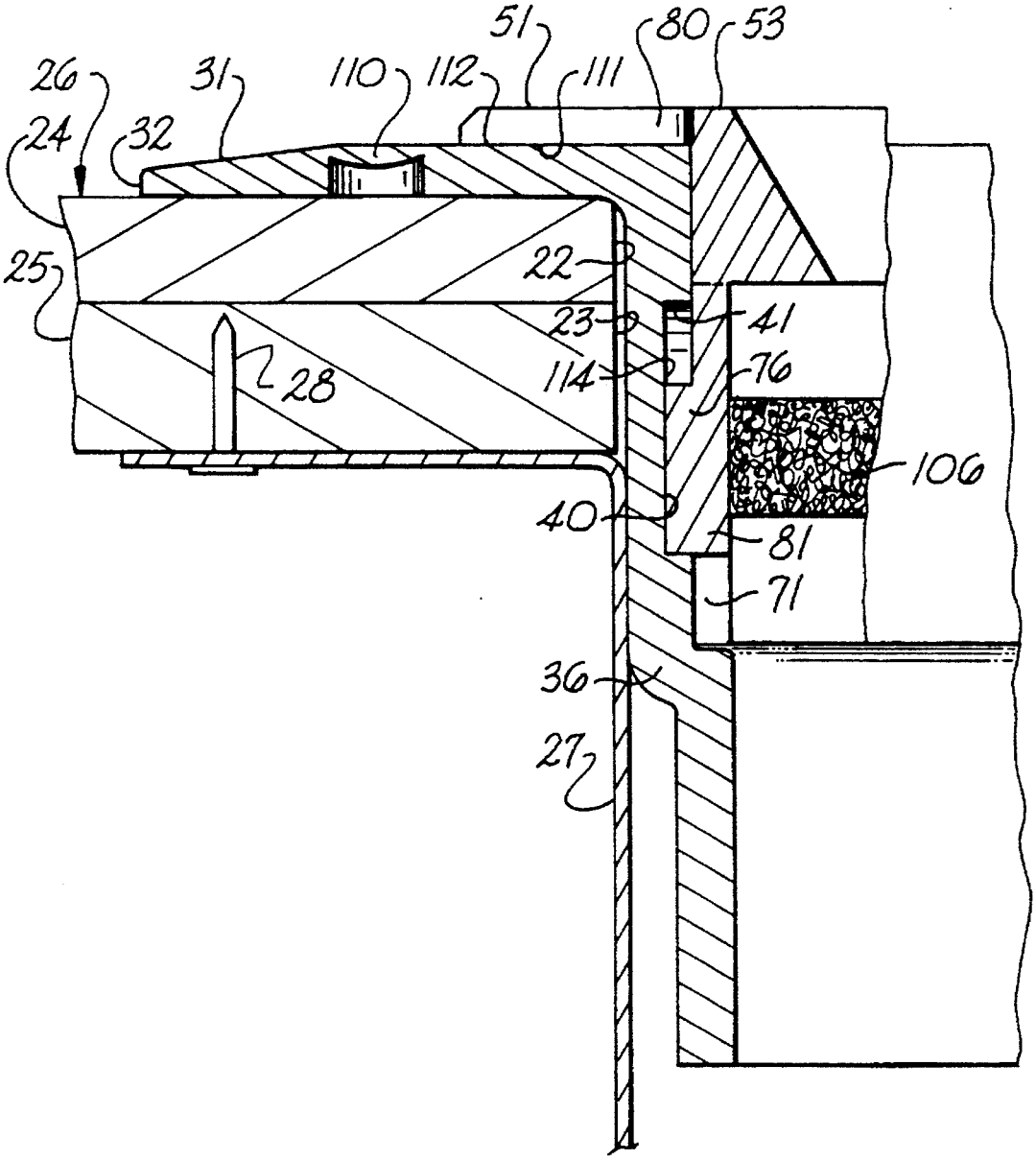
FIG. 10 is a partial cross-sectional view taken in the direction in which arrows 10—10 are pointing in FIG. 1.

A preferred embodiment of the modular, forced-air, floor register of the present invention is shown in FIG. 1 and is represented generally by the numeral 20. As shown in FIG. 1, register 20 is disposed in a hole that has been precut into the floor of a room of an edifice such as a residential home. As shown in FIGS. 9 and 10, the edges 22, 23 of flooring 24, 25 define the outline of the precut hole in the floor, generally 26, of the room of an edifice such as an office or a residential home. As shown in FIGS. 9 and 10, the walls 27 of a conventional forced-air duct are aligned with the precut holes in floor 26, and may be secured by tacks 28 to a lower floor panel 25.

In accordance with the present invention, the modular floor register of the present invention comprises two main sub-assemblies, a housing and a louver plate. The two sub-assemblies are configured to be detachably connected to each other as explained in more detail below. As explained more fully below, the louver plate includes three main components, namely, a top grille, a slide grille carried by the top grille, and an integral filter substrate carried by the slide grille.

Figure 2:
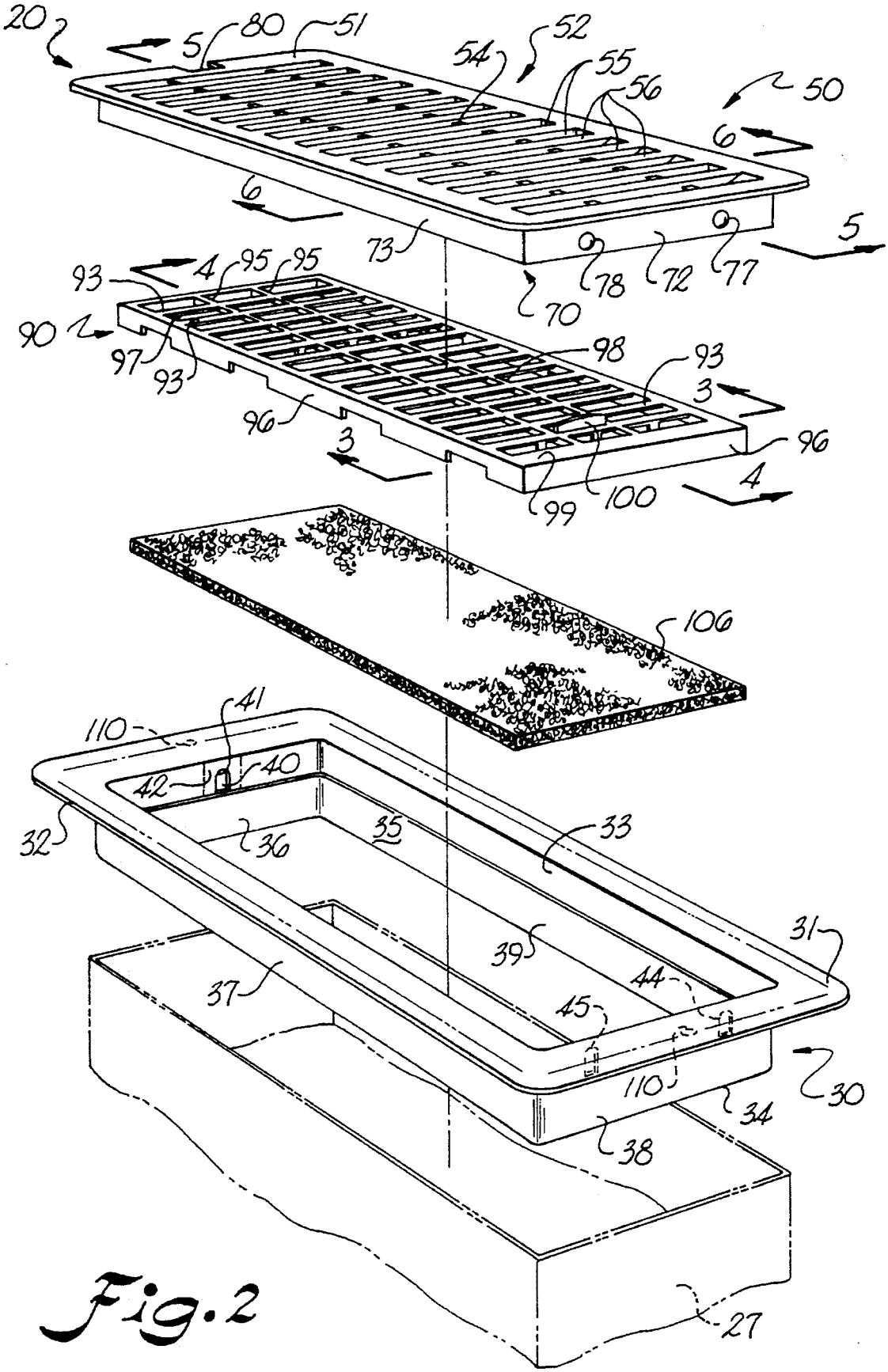
FIG. 2 is an elevated perspective view showing the assembly of various components of the register of FIG. 1 in relation to a forced-air duct that would be disposed in the hole in a floor of a room.

As shown in FIG. 2, a housing is indicated generally by the numeral 30 and includes a top flange 31. As shown in FIGS. 9 and 10, top flange 31 is configured to rest atop the floor 26 when the housing is disposed into the precut hole in the floor. As shown in FIG. 2, top flange 31 is configured as a generally flat planar member having a rectangular peripheral edge 32 and defining a first opening 33 disposed generally centrally of the top flange. As shown in FIG. 2, the configuration of first opening 33 is rectangular, but other shapes are possible. In addition to top flange 31, housing 30 also includes an outer skirt 34 that depends in a normal direction from the plane in which top flange 31 generally resides. The interior surface 35 of outer skirt 34 is defined by four planar walls connected into a rectangular configuration and disposed in alignment with first opening 33 of top flange 31. Outer skirt 34 includes a first end wall 36 and a second end wall 38 disposed generally opposite to first end wall 36. A first side wall 37 extends between the two end walls 36, 38 of outer skirt 34, and a second side wall 39 is disposed opposite to first side wall 37 and extends between the two end walls 36, 38 of outer skirt 34.

In accordance with the present invention, a selectively engageable engagement member is disposed and defined in the first end wall of the outer skirt of the housing. As embodied herein and shown in FIGS. 2 and 10 for example, the selectively engageable engagement member can be provided in the form of a pocket 40 that is too shallow to extend completely through first end wall 36 of outer skirt 34. The pocket is configured to receive a projection (described below) and has a curved outline 41 at the end of the pocket disposed toward the upper portion of first end wall 36 of outer skirt 34. The pocket 40 formed in the first end wall defines one of a pair of selectively engageable engagement members. As shown schematically in FIG. 2 by the dashed lines to each side of pocket 40, the region 42 of first end wall 36 of outer skirt 34 surrounding pocket 40 is preferably a thin walled area to increase the flexibility of the first end wall in the vicinity of pocket 40. This increased flexibility in this region 42 of first end wall, facilitates the insertion of a tool to disengage the pocket from the projection that is configured to be received in pocket 40.

In further accordance with the present invention, the second end wall defines at least one selectively lockable locking member. As embodied herein and shown in FIGS. 2 (dashed line) and 9, a selectively lockable locking member can be provided in the form of a first recess 44 defined in second end wall 38 and configured to receive a first boss (described below) therein. The first recess 44 formed in the second end wall 38 defines one of a pair of selectively lockable locking members. As embodied herein and shown in FIG. 2, second end wall 38 desirably can include a second recess 45, which is configured to receive a second boss (described below) therein. The second recess formed in the second end wall also defines one of a second pair of selectively lockable locking members. As shown schematically in FIG. 2, the second recess 45 desirably is disposed symmetrically with respect to first recess 44 and with respect to second end wall 38.

As noted above, the second major subassembly of the modular register of the present invention includes a louver plate. As embodied herein and shown in FIGS. 1, 2 and 5, a louver plate, generally 50, defines a border flange 51, which in turn defines a second opening, generally 52, that is disposed generally centrally of border flange 51. As shown in FIGS. 1 and 2, second opening 52 is configured with a rectangular outline, but other shapes may be employed for the outline of second opening 52.

Figure 5:
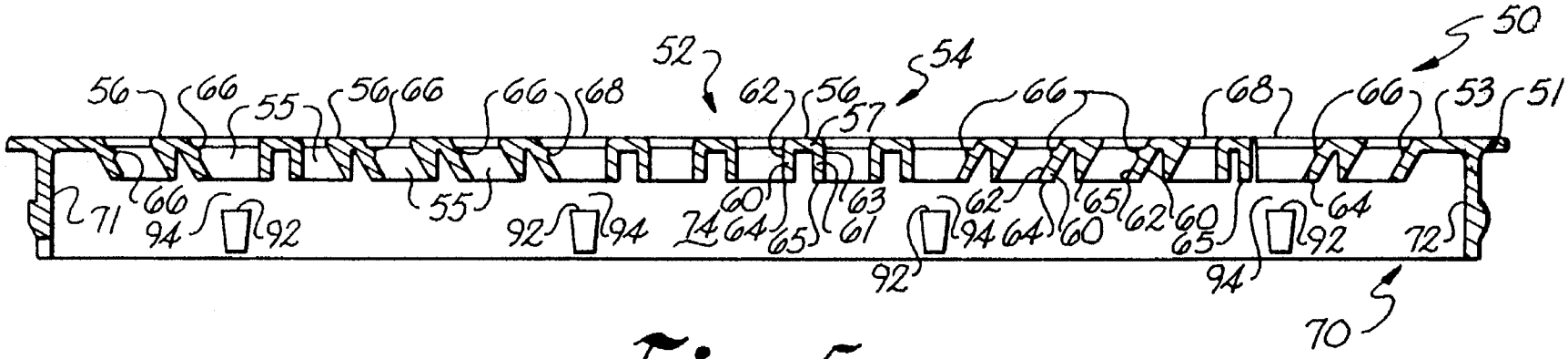
FIG. 5 is a cross-sectional view of the louver plate taken in the direction in which arrows 5—5 point in FIG. 2.

As shown in FIGS. 1, 2 and 5, louver plate 50 defines a top grille, generally 54, which is disposed across second opening 52 and includes a lattice type structure that divides second opening 52 into a plurality of spaces 55 that permit air to flow through top grille 54. As shown in FIGS. 1, 2 and 5, top grille 54 includes a plurality of elongated vanes 56. Each vane 56 extends across the width of second opening 52 and thus can be considered a width-wise vane. Each vane 56 is disposed parallel to its adjacent vane and is spaced apart from each adjacent vane to define a space 55 between adjacent vanes 56. These spaces 55 permit air to flow through top grille 54. The opposite ends of each vane are connected to border flange 51, which has a top surface 53 disposed generally in a plane. Desirably, as shown in FIG. 7 for example, each vane 56 has a top wall 57 with a top surface 58 disposed generally in the same plane as the top surface 53 of border flange 51.

Figure 7:
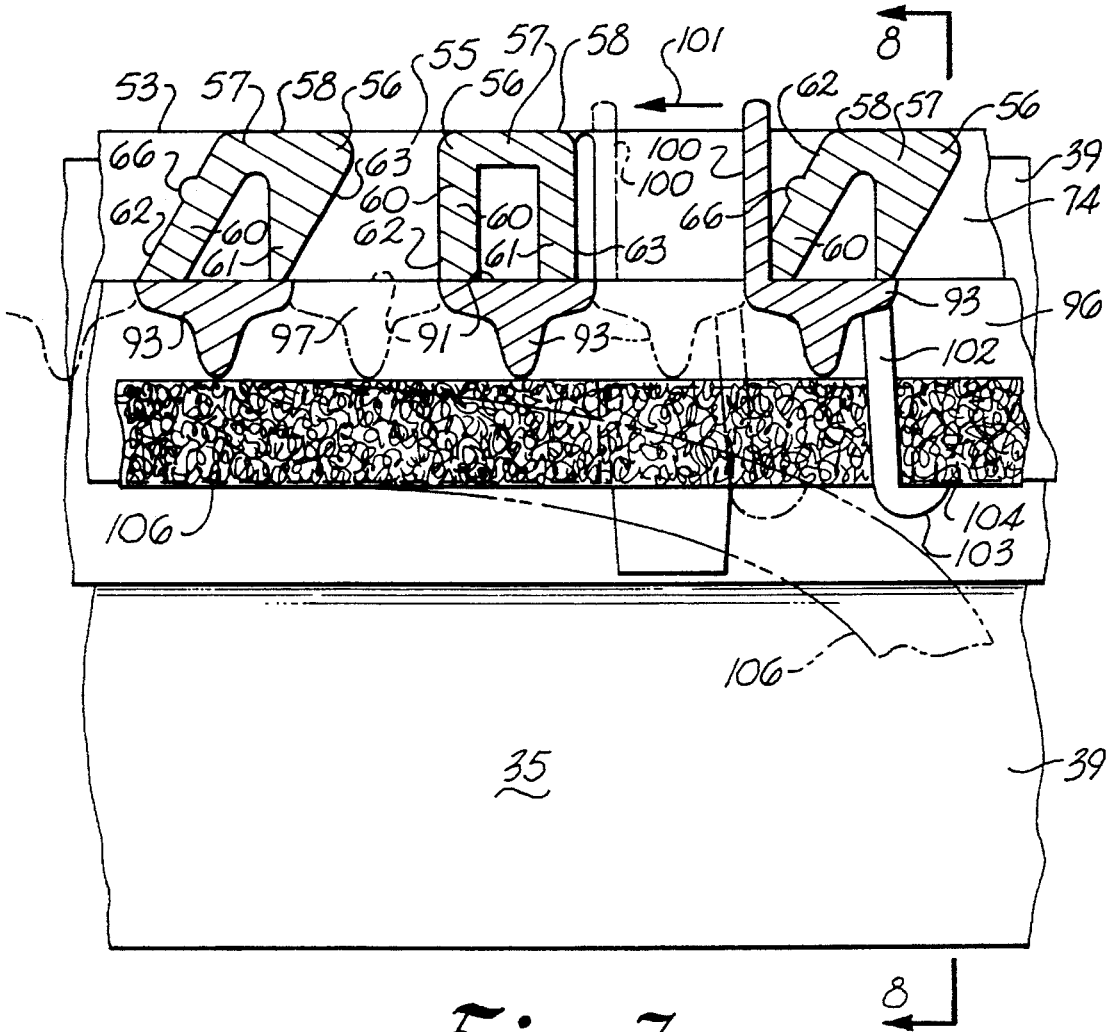
FIG. 7 is a cross-sectional view of the assembled register of the present invention shown in FIG. 1 taken in the direction in which arrows 7—7 point in FIG. 1 with alternative positions of certain components shown in phantom by dashed lines.

As shown in FIG. 7 for example, each vane 56 also includes a pair of depending side walls 60, 61. Each side wall of each vane 56 depends from an opposite side of the top wall 57 of each vane. Each side wall 60, 61 of each vane 56 has a respective outer surface 62, 63 configured and disposed parallel to the outer surface of the other side wall of each vane. As shown in FIG. 5 for example, each side wall 60, 61 of each vane 56 has a respective bottom edge 64, 65 disposed opposite to the top wall 57 of each vane. The bottom edges 64, 65 of each vane 56 are configured to terminate in the same plane, and this same plane is common to all of the vanes 56 forming top grille 54. Moreover, as shown in FIGS. 5, 7 and 9, on each upwardly facing sloped surface 62 of the side wall 60 of each angled width-wise vane 56, there is a ridge 66 disposed centrally along the side surface 62 and extending the full length of the vane's side surface. This ridge 66 is for decorative purposes.

Figure 6:
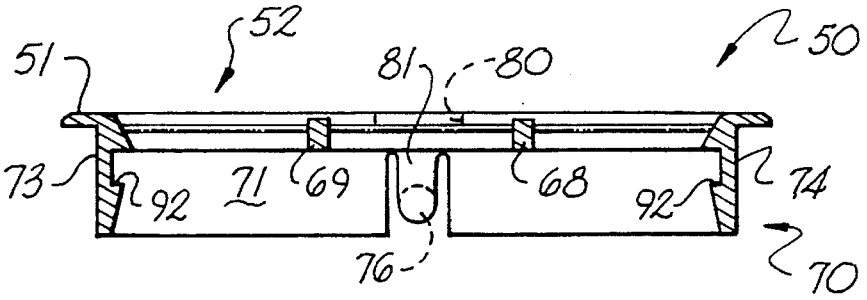
FIG. 6 is a cross-sectional view of the louver plate taken in the direction in which arrows 6—6 point in FIG. 2.

As shown in FIGS. 1, 5 and 6 for example, the lattice structure of top grille 54 also includes a first pair of reinforcing ribs 68, 69 that are disposed across the length of second opening 52 and thus may be considered length-wise ribs 68. Each reinforcing rib 68, 69 intersects each of the width-wise vanes 56 generally transversely of vanes 56 forming the lattice structure of top grille 54. As shown in FIG. 6 for example, each reinforcing rib 68 or 69 in the first pair of reinforcing ribs extends generally parallel to the other reinforcing rib 68 or 69 and desirably has an upper surface residing in the same plane as the top surface 58 of each width-wise vane 56.

As shown in FIGS. 1, 5 and 6, louver plate 50 defines an inner skirt, generally 70, configured to be inserted into first opening 33 of housing 30. Inner skirt 70 has a plurality of walls integrally formed and extending in a direction that is normal to border flange 51. The inner surface of inner skirt 70 is configured in general alignment with second opening 52. An outer surface of inner skirt 70 is configured to telescope into first opening 33 defined in top flange 31 of housing 30. As shown in FIG. 5 for example, inner skirt 70 includes a first end wall 71 and a second end wall 72 disposed generally opposite to first end wall 71. As shown in FIG. 10 for example, first end wall 71 of inner skirt 70 is configured and disposed to reside adjacent to the first end wall 36 of outer skirt 34 when the inner skirt is received in a first orientation in the first opening of housing 30. As shown in FIG. 9 for example, second end wall 72 of inner skirt 70 is configured and disposed to reside adjacent the second end wall 38 of outer skirt 34 when the inner skirt is received in the first orientation in the first opening of housing 30. As shown in FIG. 6 for example, inner skirt 70 also includes a pair of side walls 73, 74 which extend between first and second end walls 71, 72 of inner skirt 70.

In further accordance with the present invention, the inner skirt is configured to be removably securable in the first orientation with respect to outer skirt 34 of housing 30. As shown in FIGS. 6 (dashed line) and 10 for example, first end wall 71 of inner skirt 70 defines a selectively engageable engagement member in the form of a projection 76 that is configured and disposed to be engaged by the selectively engageable engagement member located on first end wall 36 of outer skirt 34 when inner skirt 70 is telescoped into outer skirt 34 in the first orientation. As shown in FIG. 10, projection 76 is configured to be received in pocket 40 formed in first end wall 36 of outer skirt 34. Similarly, a lockable locking member is provided on second end wall 72 of inner skirt 70 and configured and disposed to be locked by the selectively lockable locking member formed in second end wall 38 of outer skirt when inner skirt 70 is telescoped into outer skirt 34 in the first orientation. As shown in FIGS. 2 and 9 for example, a first boss 77 can form the locking member formed in second end wall 72 of inner skirt 70. Second end wall 72 also can be provided with a second selectively lockable locking member that is configured and disposed to lock into a second selectively lockable locking member formed in second end wall 38 of outer skirt 34. As shown in FIG. 2 for example, a second boss 78 can form the second locking member formed in second end wall 72 of inner skirt 70.

In further accordance with the present invention, a means is provided for disengaging the inner skirt from the outer skirt in order to separate the two main sub-assemblies of the register of the present invention. As embodied herein and shown in FIGS. 1, 2, 6 and 10, the sub-assembly disengaging means includes an access slot 80 that is defined through border flange 51 of louver plate 50. Access slot 80 is disposed in alignment with one of the pair of selectively engageable engagement members that is disposed on first end wall 71 of inner skirt 70. As shown in FIGS. 6 and 10 for example, the sub-assembly disengaging means also can include a resiliently biased tang 81 configured as part of first end wall 71 of inner skirt 70 and disposed to carry projection 76. In addition, as shown in FIG. 2, the sub-assembly disengaging means can include thin wall region 42 of first end wall 36 of outer skirt 34, as the reduced thickness renders this region 42 of first end wall 36 easier to deform. An operator can insert a tool such as a screwdriver or a metal coin into access slot 80 and depress tang 81 and projection 76 mounted on tang 81, inwardly towards the center of second opening 52. This movement disengages projection 76 from the selectively engageable engagement member (pocket 40) provided on outer skirt 34 and enables the louver plate 50 to be withdrawn from first opening 33 of housing 30.

In accordance with the present invention, the register 20 is a tri-directional register insofar as it directs air flow in three different directions. As shown in FIG. 5 for example, the vanes 56 of top grille 54 are grouped in three different groups of vanes. Each group of vanes is configured and disposed to direct the flow of air exiting the register, in one of three different directions. A first of the three groups of vanes is characterized by having the outer surfaces 62 of the side walls 60 of each vane disposed at an angle tilted toward one of the end walls 71 or 72 of inner skirt 70 and away from the center of second opening 52. Each vane 56 in the first group is desirably disposed adjacent to another vane 56 in the first group. A second of the three groups of vanes is characterized by having the outer surfaces 62 of side walls 60 of each vane disposed at an angle tilted toward the other end wall 72 or 71 of inner skirt 70 and away from the center of second opening 52. Each vane in this second group is desirably disposed adjacent to another vane in the second group of vanes. A third group of vanes is characterized by having each vane with the outer surfaces 62, 63 of the respective walls of each vane 56 disposed generally vertically, which is in a direction normal to the plane containing the upper surfaces of the first pair of reinforcing ribs 68, 69 and the top surfaces 58 of vanes 56. The third group of vanes is disposed generally between the first group of vanes and the second group of vanes. Each vane in the third group of vanes is desirably disposed adjacent to another vane in the third group of vanes. However, as shown in FIG. 5 for example, one vane from this third group of vanes is interspersed among the vanes of the first group of vanes, and one vane from the third group of vanes is interspersed among the vanes in the second group of vanes.

Figure 8:
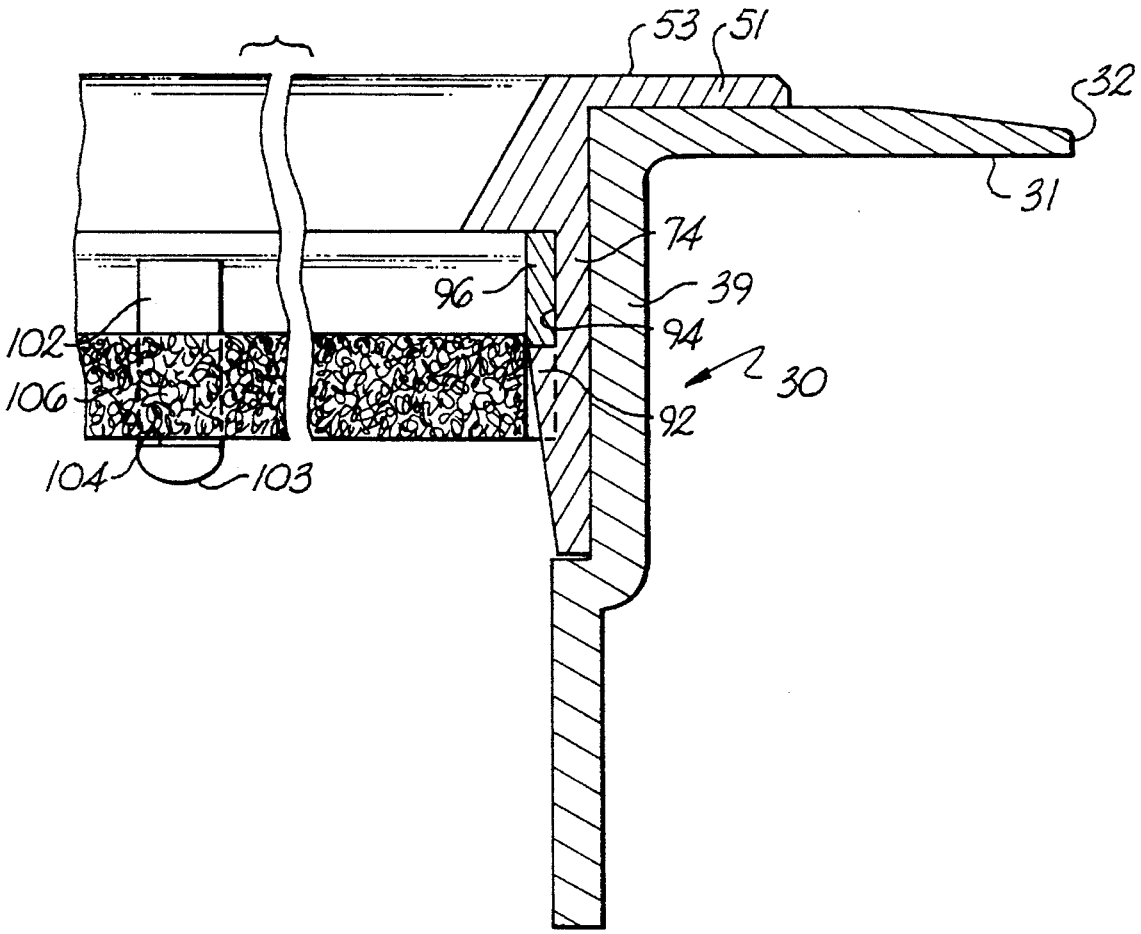
FIG. 8 is a partial cross-sectional view taken in the direction in which arrows 8—8 are pointing in FIG. 7.

In further accordance with the present invention, the louver plate can be provided with a means for regulating the amount of air flowing through the register into the room. As embodied herein and shown in FIGS. 2–4 for example, the means for regulating the amount of air flowing through the register into the room can include a slide grille, generally 90, disposed within a sliding groove provided in the louver plate. As shown in FIG. 6 for example, inner skirt 70 of louver plate 50 includes a first side wall 73 and a second side wall disposed 74 generally opposite to first side wall 73. Each side wall 73, 74 is disposed between end walls 71, 72 of inner skirt 70. As shown in one or more of FIGS. 6, 5 and 8, each side wall 73, 74 of inner skirt 70 defines at least one support ridge 92, and desirably a plurality of support ridges 92. As shown in FIG. 5 for example, each support ridge 92 is disposed beneath and spaced apart from bottom edges 64, 65 of vanes 56 forming the lattice grid work of top grille 54. As shown in FIGS. 5 and 8, a sliding groove 94 is defined between bottom edges 64, 65 of vanes 56 and ridges 92 formed in side walls 73, 74 of inner skirt 70. As shown in FIGS. 2–4 and 8, slide grille 90 has a peripheral flange 96 that is configured and disposed to slide within sliding groove 94 of louver plate 50.

Figure 4:
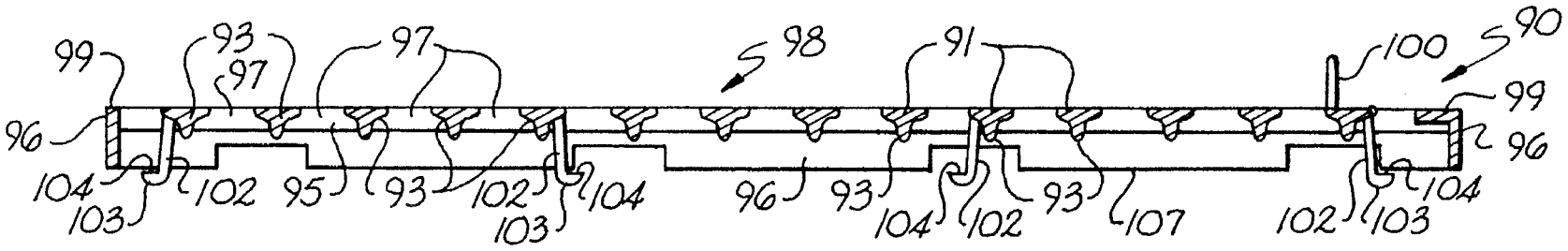
FIG. 4 is a cross-sectional view of the slide grille taken in the direction in which the arrows 4—4 point in FIG. 2.

As shown in FIGS. 2 and 4, peripheral flange 96 of slide grille 90 defines a third opening 98 disposed generally centrally of slide grille 90. As shown in FIG. 2, third opening 98 is shaped in a rectangular outline, but other shapes could be provided. As shown in FIGS. 2 and 4, slide grille 90 also can be provided with a lattice network of cover vanes 93 and reinforcing ribs 95. As shown in FIG. 4, each cover vane 93 has a transverse cross-sectional shape resembling a "T." A plurality of elongated cover vanes 93 extends parallel to each other and disposed across the width dimension of third opening 98. Each cover vane 93 is spaced apart from each adjacent cover vane to define a gap 97 between each adjacent pair of cover vanes 93. The opposite ends of each cover vane are connected and integral with peripheral flange 96, which has a top surface 99 disposed generally in a plane. As shown in FIG. 4, each cover vane 93 also has a top surface 91 disposed generally in the same plane as the top surface 99 of peripheral flange 96. As shown by the dashed outline of cover vanes in FIG. 7 for example, each top surface 91 of each cover vane 93 desirably is configured and disposed to completely cover an opposing space 55 between adjacent vanes 56 of top grille 54 when the slide grille 90 is disposed in a cover orientation within sliding groove 94. When slide grille is disposed in an open orientation, as shown in solid line in FIG. 7 for example, the gaps 97 between adjacent cover vanes 93 are in direct communication with the spaces 55 between adjacent vanes of top grille 54.

As shown in FIGS. 1–4 and 7, a handle 100 can be integrally formed as part of slide grille 90 and can be configured and disposed to extend above top surfaces 91 of cover vanes 93. Handle 100 is configured and disposed to be manipulated when slide grille 90 is disposed in sliding groove 94. As schematically shown by the arrow designated 101 in FIG. 7, the operator can manipulate handle 100 to regulate the amount of air by orienting the cover vanes 93 in either an open or closed position with respect to the corresponding spaces 55 between adjacent vanes 56 of top grille 54. The solid line depictions of cover vanes 93, handle 100 and hooking member 102 (described below) correspond to the fully open position of the register. The dashed line depiction of cover vanes 93, handle 100 and hooking member 102 correspond to the fully closed position of the register. The operator also can manipulate the handle 100 so as to dispose the cover vanes 93 in any intermediate position between fully open and fully closed.

Figure 3:
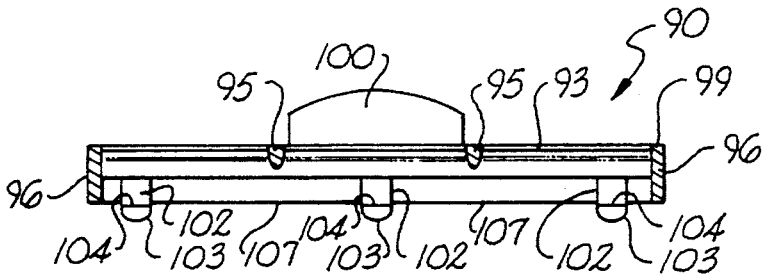
FIG. 3 is an end plan view of the slide grille taken in the direction in which the arrows 3—3 point in FIG. 2.

In still further accordance with the present invention, a means can be provided for securing an integral filter substrate to the slide grille that opens and closes the register to the flow of air therethrough. As embodied herein and shown in FIGS. 3, 4, and 7–9 for example, the securing means can include a plurality of hooking members 102 configured and disposed to extend from slide grille 90 in the direction that is away from top grille 54 and toward the location from which the air flow is expected to advance toward the register 20 when the register is in use in the hole formed in the floor of a room. As shown in FIGS. 7–9 for example, each hooking member 102 desirably has a rounded free end 103 that can be used to impale or punch through an integral filter substrate. As shown in FIGS. 3 and 4 for example, each hooking member 102 is configured with a ledge portion 104 disposed to carry and retain an integral filter substrate in position in the path of air that moves from the source of the air through the register 20 and into the room served by the register.

As shown in FIGS. 2 and 7–10, an integral filter substrate 106 can be provided in the configuration of a pad having a thickness that can be impaled by hooking members 102. Desirably, the shape of the outline of filter substrate 106 should be the same as the outline of slide grille 90. Filter substrate 106 is retained by ledges 104 of hooking members 102, which are formed in a shape resembling a "J" and thus may be called J-shaped members. Alternatively, hooking members could have free ends configured as the point of an arrow head with barbs. As shown in FIGS. 3 and 4 for example, the J-shaped members 102 extend below the bottom edge 107 of slide grille 90 and desirably are configured in groups disposed along the length of a cover vane 93. As shown in FIG. 4, not every cover vane 93 needs to be provided with hooking members 102, and the number and disposition of the hooking members 102 will be determined by the shape, thickness, and weight of the filter substrate 106. Desirably, the integral filter substrate can be formed of a plastic material, preferably polyurethane foam. Applicants presently intend to use a 7/32 inch thick 30 ppi polyurethane foam pad for filter substrate 106, but 20 ppi to 40 ppi foam pads likely would be satisfactory.

With the exception of the filter substrate 106, the other components of the register 20 can be formed of molded plastic, preferably high impact polystyrene. Suitable materials include any rigid plastic materials that have enough flexibility to permit the formation of tang 81 in first end wall 71 of inner skirt 70 of louver plate 50 and the formation of thin wall region 42 surrounding pocket 40 in first end wall 36 of outer skirt 30.

In operation, the housing of the filter register of the present invention is disposed into a precut hole formed in the floor of a room. If desired, the plugs 110 (dashed line circles shown in FIGS. 1 and 2 and solid line in FIG. 10) formed in top flange 31 can be punched out to provide holes for receiving nails or screws to secure top flange 31 to the floor. The louver plate sub-assembly, including a filter substrate 106 attached to the slide grille 90 by the hooking members 102, can be inserted into first opening 33 formed in housing 30. Desirably, as first and second end walls 71, 72 of inner skirt 70 are inserted into first opening 33 of outer skirt 34, projection 76 is received in pocket 40 formed in first end wall 36 of outer skirt 34 while first and second bosses 77, 78 are inserted into respective first and second recesses 44, 45 formed in second end wall 38 of outer skirt 30. The resilient flexibility of tang 81 and thin wall region 42 ensure that projection 76 is biased into pocket 40 of first end wall 36 of housing 30.

After considerable use of the register of the present invention in place in the floor, it may become desirable to clean the filter of the register. The modular construction of the register of the present invention permits the two main sub-assemblies to be separated from one another for ease of cleaning the filter. As shown in FIG. 10, when projection 76 is engaging pocket 40 in a manner so that the underside 111 of border flange 51 rests atop the top surface 112 of top flange 31, the upper region 114 of pocket 40 is unoccupied by projection 76. A person easily can insert a lever, such as in the form of a screwdriver blade or a coin, between border flange 51 and top flange 31 to raise louver plate 50 slightly above top flange 31. In doing so, projection 76 would move into the previously unoccupied upper region 114 of pocket 40. Once the end of louver plate adjacent the first end wall 71 of inner skirt 70 is raised a small distance above top flange 31 of housing 30, a person easily can insert a lever through access slot 80 and depress tang 81 away from first end wall 36 of outer skirt 34 of housing 30 and toward the center of first opening 33. This insertion of the lever to pry projection 76 apart from pocket 40 is facilitated by the increased the flexibility of thin wall region 42 of first end wall 36 of outer skirt 34 surrounding pocket 40, as schematically shown in FIG. 2 by the dashed lines defining thin wall region 42 to each side of pocket 40.

With such movement, projection 76 is withdrawn from within the pocket 40 formed in first end wall 36 of outer skirt 34, thereby releasing the engagement between louver plate 50 and housing 30 and thus releasing the engagement between the two main subassemblies. Louver plate 50 then can be lifted out of first opening 33 and carried to a water faucet (not shown), which can be turned on to provide a flow of water against the filter 106. The flow of water can remove the dust and other particles from the filter without the operator having to touch the filter. If the filter needs to be replaced, it also can be washed before the operator needs to touch the soiled filter to remove it prior to replacement with a new filter. As schematically shown in FIG. 7, filter substrate 106 is depicted in dashed line form to indicate its position while being attached to or detached from slide grille 90.

What is claimed is:

1. A modular, forced-air register to be disposed in a precut hole in the floor of a room for admitting air into the room from a heating and air conditioning system, comprising:

a housing, said housing defining a top flange configured to rest atop the floor when said housing is disposed into the precut hole in the floor, said top flange defining a first opening disposed generally centrally of said top flange;

a louver plate, said louver plate defining a border flange, said border flange defining a second opening disposed generally centrally of said louver plate;

said louver plate defining a top grille, said top grille including a plurality of elongated vanes extending across said second opening and spaced apart from each other to define a space between each pair of adjacent vanes, each said vane having a bottom edge;

said louver plate defining an inner skirt depending normally from said border flange, said inner skirt having an inner surface configured in alignment with said second opening, said inner skirt having an outer surface configured to telescope into said first opening defined in said top flange of said housing;

said inner skirt including a first side wall and a second side wall disposed generally opposite to said first side wall, each said side wall of said inner skirt defining at least one support ridge disposed beneath and spaced apart from said bottom edges of said vanes, said ridges and said bottom edges of said vanes defining a sliding groove therebetween;

a slide grille disposed to slide in said sliding groove, said slide grille including a peripheral flange defining a third opening disposed generally centrally of said slide grille, said peripheral flange being configured and disposed to slide within said sliding groove of said louver plate;

said slide grille including a plurality of elongated cover vanes extending parallel to each other and disposed across said third opening and spaced apart from each other to define a gap between each adjacent pair of said cover vanes;

a means for securing an integral filter substrate to said slide grille, wherein said securing means includes:

a plurality of hooking members configured and disposed to extend from said slide grille in the direction away from said top grille, each said hooking member having a barbed free end, and wherein said filter substrate is configured in the form of a pad and disposed impaled by said hooking members and retained by said barbed free ends from releasing from said hooking members; and an integral filter substrate secured to said slide grille by said securing means.

2. An apparatus as in claim 1, wherein:

said peripheral flange having a top surface disposed generally in a plane, each said cover vane having a top surface disposed generally in the same plane as said top surface of said peripheral flange, each top surface of each said cover vane being configured and disposed to completely cover an opposing space between adjacent vanes of said top grille when said slide grille is disposed in a cover orientation in said sliding groove.

3. An apparatus as in claim 2, further comprising:

a handle connected to said slide grille, said handle being configured and disposed to extend above said top surfaces of said cover vanes and being configured and disposed to be manipulated to move said slide grille between said cover orientation and an open orientation wherein said top surfaces of said cover vanes are disposed away from covering an opposing space between adjacent vanes of said top grille.

4. An apparatus as in claim 1, wherein:

said border flange having a top surface disposed generally in a plane, each said vane having a top wall with a top surface disposed generally in the same plane as said top surface of said border flange, each said vane having a pair of side walls, each said side wall of each said vane depending from an opposite side of said top wall of each said vane, each said side wall of each said vane having an outer surface configured and disposed parallel to the outer surface of the other side wall of each said vane; and said vanes of said top grille being grouped in one of three groups of vanes, a first of said groups of vanes having said outer surfaces of said side walls disposed at an angle tilted toward one of said end walls of said inner skirt and away from the center of said second opening, each vane in said first group being disposed adjacent one another, a second of said groups of vanes having said outer surfaces of said side walls disposed at an angle tilted toward the other of said end walls of said inner skirt and away from the center of said second opening, each vane in said second group being disposed adjacent one another, a third of said groups of vanes having each vane in said third group disposed adjacent one another, said third group of vanes being disposed between said first group of vanes and said second group of vanes.

5. An apparatus as in claim 4, further comprising:

a first pair of reinforcing ribs disposed across said second opening of said louver plate and intersecting said vanes generally transversely of said vanes, each said reinforcing rib of said first pair of reinforcing ribs extending generally parallel to the other said reinforcing rib.

6. An apparatus as in claim 5, further comprising:

a second pair of reinforcing ribs disposed across said third opening of said slide grille and intersecting said cover vanes generally transversely of said cover vanes, said second pair of reinforcing ribs extending generally parallel to each other and disposed generally in alignment with said first pair of reinforcing ribs of said top grille.

7. A modular, forced-air register to be disposed in a precut hole in the floor of a room for admitting air into the room from a heating and air conditioning system, comprising:

a housing, said housing defining a top flange configured to rest atop the floor when said housing is disposed into the precut hole through the floor, said top flange defining a first opening disposed generally centrally of said top flange;

a louver plate, said louver plate defining a border flange, said border flange defining a second opening disposed generally centrally of said louver plate;

said louver plate defining a top grille, said top grille including a plurality of elongated vanes extending across said second opening and spaced apart from each other to define a space between each pair of adjacent vanes, each said vane having a bottom edge;

said louver plate defining an inner skirt depending normally from said border flange, said inner skirt having an inner surface configured in alignment with said second opening, said inner skirt having an outer surface configured to telescope into said first opening defined in said top flange of said housing; said inner skirt including a first side wall and a second side wall disposed generally opposite to said first side wall, each said side wall of said inner skirt defining at least one support ridge disposed beneath and spaced apart from said bottom edges of said vanes, said ridges and said bottom edges of said vanes defining a sliding groove therebetween;

a slide grille disposed to slide in said sliding groove, said slide grille including a peripheral flange defining a third opening disposed generally centrally of said slide grille, said peripheral flange being configured and disposed to slide within said sliding groove of said louver plate;

said slide grille including a plurality of elongated cover vanes extending parallel to each other and disposed across said third opening and spaced apart from each other to define a gap between each adjacent pair of said cover vanes;

a means for securing an integral filter substrate to said slide grille; an integral filter substrate secured to said slide grille by said securing means;

wherein said housing defining an outer skirt depending normally from said top flange and configured in alignment with said first opening, said outer skirt including a first end wall and a second end wall disposed generally opposite to said first end wall, said first end wall defining a one of a pair of selectively engageable engagement members, said second end wall defining one of a pair of selectively lockable locking members; and said inner skirt including a first end wall and a second end wall disposed generally opposite to said first end wall, said first end wall of said inner skirt being configured and disposed to reside adjacent said first end wall of said outer skirt when said inner skirt is received in a first orientation in said first opening of said top flange of said housing, said second end wall of said inner skirt being configured and disposed to reside adjacent said second end wall of said outer skirt when said inner skirt is received in said first orientation in said first opening of said top flange of said housing, said first end wall of said inner skirt defining the other of said pair of selectively engageable engagement members in a disposition to be engaged by said one of said pair of selectively engageable engagement members when said inner skirt is telescoped into said first orientation in said outer skirt, said second end wall of said inner skirt defining the other of said pair of selectively lockable locking members in a disposition to be locked by said one of said pair of selectively lockable locking members when said inner skirt is telescoped into said first orientation in said outer skirt.

8. An apparatus as in claim 7, wherein said securing means includes:

a plurality of hooking members configured and disposed to extend from said slide grille in the direction away from said top grille, each said hooking member having a barbed free end; and wherein said filter substrate is configured in the form of a pad and disposed impaled by said hooking members and retained by said barbed free ends from releasing from said hooking members.

9. An apparatus as in claim 7, further comprising:

a means for disengaging said inner skirt from said outer skirt in order to separate the register into two main sub-assemblies.

10. An apparatus as in claim 9, wherein said disengaging means includes:

an access slot defined through said border flange of said louver plate and disposed in alignment with said one of said pair of selectively engageable engagement members disposed on said first end wall of said inner skirt.

11. An apparatus as in claim 9, wherein said disengaging means includes:

a resiliently biased tang configured and disposed to carry said one of said pair of selectively engageable engagement members disposed on said first end wall of said inner skirt.

12. An apparatus as in claim 9, wherein said disengaging means includes:

a thin wall region configured and disposed to carry said one of said pair of selectively engageable engagement members disposed on said first end wall of said outer skirt.

13. A modular, forced-air register to be disposed in a precut hole in the floor of a room for admitting air into the room from a heating and air conditioning system, comprising:

a housing, said housing defining a top flange configured to rest atop the floor when said housing is disposed into the precut hole in the floor, said top flange defining a first opening disposed generally centrally of said top flange;

said housing defining an outer skirt depending normally from said top flange and configured in alignment with said first opening, said outer skirt including a first end wall and a second end wall disposed generally opposite to said first end wall, said first end wall defining a one of a pair of selectively engageable engagement members, said second end wall defining one of a pair of selectively lockable locking members;

a louver plate, said louver plate defining a border flange, said border flange defining a second opening disposed generally centrally of said louver plate;

said louver plate defining a top grille, said top grille including a plurality of elongated vanes extending parallel to each other and disposed across said second opening and spaced apart from each other to define a space between adjacent vanes, each said vane having opposite ends connected to said border flange, said border flange having a top surface disposed generally in a plane, each said vane having a top wall with a top surface disposed generally in the same plane as said top surface of said border flange, each said vane having a pair of side walls, each said side wall of each said vane depending from an opposite side of said top wall of each said vane, each said side wall of each said vane having an outer surface configured and disposed parallel to the outer surface of the other side wall of each said vane;

a first pair of reinforcing ribs disposed across said second opening and intersecting said vanes generally transversely of said vanes, each said reinforcing rib of said first pair of reinforcing ribs extending generally parallel to the other said reinforcing rib;

said vanes of said top grille being grouped in one of three groups of vanes, a first of said groups of vanes having said outer surfaces of said side walls disposed at an angle tilted toward one of said end walls of said inner skirt and away from the center of said second opening, each vane in said first group being disposed adjacent one another, a second of said groups of vanes having said outer surfaces of said side walls disposed at an angle tilted toward the other of said end walls of said inner skirt and away from the center of said second opening, each vane in said second group being disposed adjacent one another, a third of said groups of vanes having each vane in said third group disposed adjacent one another, said third group of vanes being disposed between said first group of vanes and said second group of vanes;

said louver plate defining an inner skirt depending normally from said border flange, said inner skirt having an inner surface configured in alignment with said second opening, said inner skirt having an outer surface configured to telescope into said first opening defined in said top flange of said housing, said inner skirt including a first end wall and a second end wall disposed generally opposite to said first end wall, said first end wall of said inner skirt being configured and disposed to reside adjacent said first end wall of said outer skirt when said inner skirt is received in a first orientation in said first opening of said top flange of said housing, said second end wall of said inner skirt being configured and disposed to reside adjacent said second end wall of said outer skirt when said inner skirt is received in said first orientation in said first opening of said top flange of said housing, said first end wall of said inner skirt defining the other of said pair of selectively engageable engagement members in a disposition to be engaged by said one of said pair of selectively engageable engagement members when said inner skirt is telescoped into said first orientation in said outer skirt, said second end wall of said inner skirt defining the other of said pair of selectively lockable locking members in a disposition to be locked by said one of said pair of selectively lockable locking members when said inner skirt is telescoped into said first orientation in said outer skirt;

an access slot defined through said border flange of said louver plate and disposed in alignment with said one of said pair of selectively engageable engagement members disposed on said first end wall of said inner skirt;

said inner skirt including a first side wall and a second side wall disposed generally opposite to said first side wall, each said side wall being disposed between said end walls of said inner skirt, each said side wall of each said vane having a bottom edge disposed opposite said top wall of each said vane, each said side wall of said inner skirt defining at least one support ridge disposed beneath and spaced apart from said bottom edges of said vanes, said ridges and said bottom edges of said vanes defining a sliding groove therebetween;

a slide grille, said slide grille including a peripheral flange defining a third opening disposed generally centrally of said slide grille, said peripheral flange being configured and disposed to slide within said sliding groove of said louver plate;

said slide grille including a plurality of elongated cover vanes extending parallel to each other and disposed across said third opening and spaced apart from each other to define a gap between each adjacent pair of said cover vanes, each said cover vane having opposite ends connected to said peripheral flange, said peripheral flange having a top surface disposed generally in a plane, each said cover vane having a top surface disposed generally in the same plane as said top surface of said peripheral flange, each top surface of each said cover vane being configured and disposed to completely cover an opposing space between adjacent vanes of said top grille when said slide grille is disposed in a cover orientation in said sliding groove;

said slide grille including a handle configured and disposed to extend above said top surfaces of said cover vanes and configured and disposed to be manipulated when said slide grille is disposed in said sliding groove;

said slide grille including a plurality of hooking members, each said hooking member being configured to extend in the opposite direction from said handle and having a barbed free end;

an integral filter substrate, said filter substrate being configured in the form of a pad and disposed impaled by said hooking members and retained by said barbed free ends from releasing from said hooking members; and a second pair of reinforcing ribs disposed across said third opening of said slide grille and intersecting said cover vanes generally transversely of said cover vanes, said second pair of reinforcing ribs extending generally parallel to each other and disposed generally in alignment with said first pair of reinforcing ribs of said top grille.

* * * * *